United States Patent [19]

Naslund et al.

[11] Patent Number: 4,536,149

[45] Date of Patent: Aug. 20, 1985

[54] APPARATUS FOR MAKING GROOVES IN CIGARETTE FILTERS

[75] Inventors: Erik I. Naslund, Los Gatos; Steven P. Reed, Felton, both of Calif.

[73] Assignee: Brown & Williamson Tobacco Corporation, Louisville, Ky.

[21] Appl. No.: 632,166

[22] Filed: Jul. 18, 1984

[51] Int. Cl.[3] ..... B29D 17/00

[52] U.S. Cl. ..... 425/394; 425/397

[58] Field of Search ..... 425/394, 397

[56] References Cited

U.S. PATENT DOCUMENTS 3,680,998 8/1972 Sharman ..... 425/394

4,238,179 12/1980 Flabres et al. ..... 425/394

*Primary Examiner*—J. Howard Flint, Jr.

*Attorney, Agent, or Firm*—Charles G. Lamb

[57] ABSTRACT

An apparatus for, in one advantageous embodiment, concurrently forming a plurality of generally longitudinally extending grooves in a filter rod, and in another advantageous embodiment, for making small apertures in the grooves as the grooves are being formed in the filter rod. The apparatus includes a reciprocating die having an upper and lower die block. Each die block includes protruding, elongated projections which are adapted to be embedded into the filter rod upon closing of the die to impress grooves in the filter rod located in the die. In the embodiment wherein apertures are to be formed in the grooves, aperture forming punches are associated with each of the groove forming projections for punching apertures in the grooves as they are being formed. The apparatus further includes a filter rod conveying device located between the upper and lower die blocks for guiding the filter rods through the die and for positioning the filter rods to be grooved in the reciprocating die.

18 Claims, 8 Drawing Figures

APPARATUS FOR MAKING GROOVES IN CIGARETTE FILTERS

BACKGROUND OF THE INVENTION

1. Field of the Invention

The present invention relates to the manufacture of filters for cigarettes and more particularly to the making of grooves in cigarette filters. In addition, the present invention relates to the making of apertures in the grooves at preselected locations.

2. Description of the Prior Art

Cigarettes are often provided with filter devices at one end to remove materials from the smoke stream coming from the tobacco column during smoking. These filters, which are attached to the tobacco column, come in many different sizes, shapes and forms. Some filters which are presently on the market include grooves. In some filter constructions the grooves facilitate the by-passing of smoke around the filter. In other filter constructions the grooves provide a channel for mixing ventilating air and by-passed smoke. In still other constructions the grooves provide a path for only ventilating air to pass therealong without mixing with smoke.

In the manufacture of grooved cigarette filters, many suggestions have been made for making the grooves in the filter rod. U.S. Pat. No. 3,804,695 shows the use of a pair of parallel rollers in pressure engagement defining a nip therebetween wherein one of the rollers is provided with a circumferential or a helical grooved surface so that, as a filter rod passes therethrough, permanent depressions are made along the longitudinal dimensions of the filter rod. U.S. Pat. No. 4,075,936 shows a die having cam manipulated radically reciprocating pins that periodically move into and out of the longitudinal path of a filter rod as the filter rod tow moves past. When the pins extend into the path of the tow they impress grooves on the filter rod. U.S. Pat. No. 4,149,546 shows an apparatus for making grooves in a cigarette filter wherein a filter rod is moved in an arcuate path transverse to a heated forming means, the filter rod being supported and conveyed for relative movement at the periphery of a drum-shaped inner rotor and the forming means compresses a heated arcuate outer stator element or elements projecting inwardly toward the rotor. U.S. Pat. No. 4,324,540 teaches an apparatus for making grooves in filters which comprises a plurality of fixed position groove forming blades and filter plug conveying device located next to the groove forming blades. Cigarette filters to be grooved are moved along the path between the conveyor device and blades, rolling past the blades whereupon grooves are formed in the filters by the blades.

SUMMARY OF THE INVENTION

The present invention provides an apparatus for making grooves in cigarette filter rods. The present invention also provides an apparatus for making grooves in filter rods and small apertures in the grooves.

More particularly, the present invention provides an apparatus for making grooves in filter rods comprising die means comprising a lower die block and an upper die block, both die blocks being adapted for movement toward and away from each other, the lower die block having elongated groove forming projections projecting generally toward the upper die block, and the upper die block having elongated groove forming projections projecting generally toward the lower die block, whereby the groove forming projections of the lower die block and upper die block are adapted to be embedded into a filter rod disposed between the lower and upper die blocks to impress grooves in the filter rod when the lower and upper die blocks are moved toward each other, means disposed between the lower and upper die blocks defining a path of travel of the filter rods through the die means, means associated with the path defining means for positioning the filter rods to be grooved in the die means between the lower and upper die blocks in longitudinal alignment with selected groove forming projections and generally transverse to the path of travel of the filter rods, stripper means for holding the grooved filter rods in the path defining means as the lower and upper die blocks move away from each other to allow the groove forming projections to be extracted from the filter rod, and means for moving the lower and upper die blocks toward and away from each other.

BRIEF DESCRIPTION OF THE DRAWINGS

A more complete understanding of the present invention will be obtained upon reference to the following description in conjunction with the accompanying drawings wherein.

DESCRIPTION OF THE PREFERRED EMBODIMENTS

Figure 1:
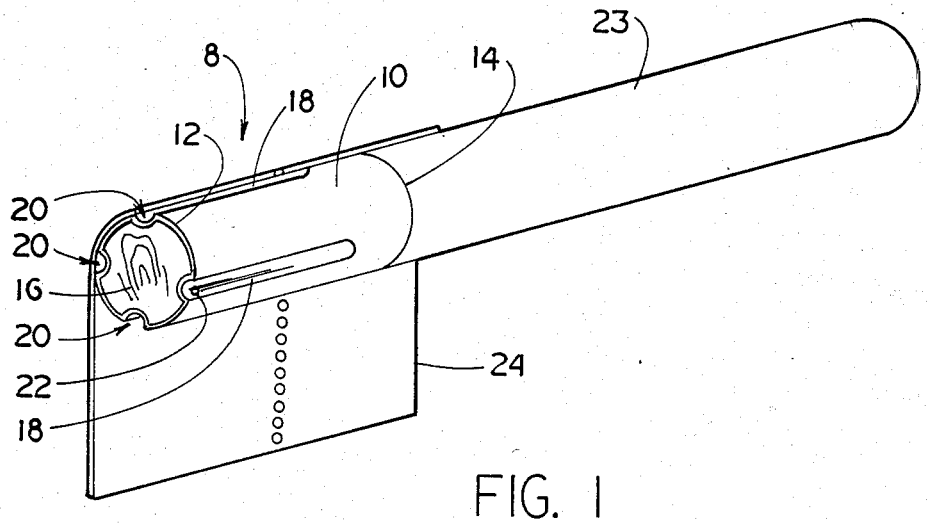
FIG. 1 is a perspective view of a cigarette having a filter rod attached thereto, the apparatus of the present invention being capable of manufacturing the filter rod.

Novel cigarette filters 8 of the type illustrated in FIG. 1 comprise a generally cylindrically shaped filter rod 10 fabricated of an air and smoke permeable material and a circumscribing wrapper 12 fabricated of an air and smoke impermeable material. The wrapper 12 extends longitudinally of the filter rod 10 from one end 14 of the filter rod 10 to the other end 16 thereof so that the filter rod ends 14 and 16 are in mutual flowthrough relationship. The filter 8 includes a plurality of grooves 18 formed in the wrapper 12 and embedded into the filter rod 10. Each of the grooves 18 is open, as designated by the number 20, at the mouth end 16 of the filter rod 10 and extends therefrom in a generally longitudinal direction of the filter rod 10 for a distance less than the length of the filter rod 10. The grooves 18 are illustrated as being four in number, and equally spaced from each other about the circumference of the filter rod 10. As an optional feature, the filter rod 10 can be provided with small apertures 22 formed through the thickness of the embedded portion of the wrapper 12 defining the grooves 18. As shown, one aperture 22 is formed in each groove 18 adjacent to the mouth end 16 of the filter rod 10, however, it is known that more than one aperture 22 in each groove 18 can be formed. The filter rod 10 is attached to a tobacco column 23 by means of an air permeable tipping material 24 which circumscribes the filter rod and overlaps a portion of the tobacco column in a manner known in the art to form a filtered cigarette. The tipping material is formed with perforations to allow ambient air to flow into the grooves 18.

In FIG. 1, the tipping material is shown in a partially unwrapped position to more clearly show details of the filter rod 10.

Figure 2:
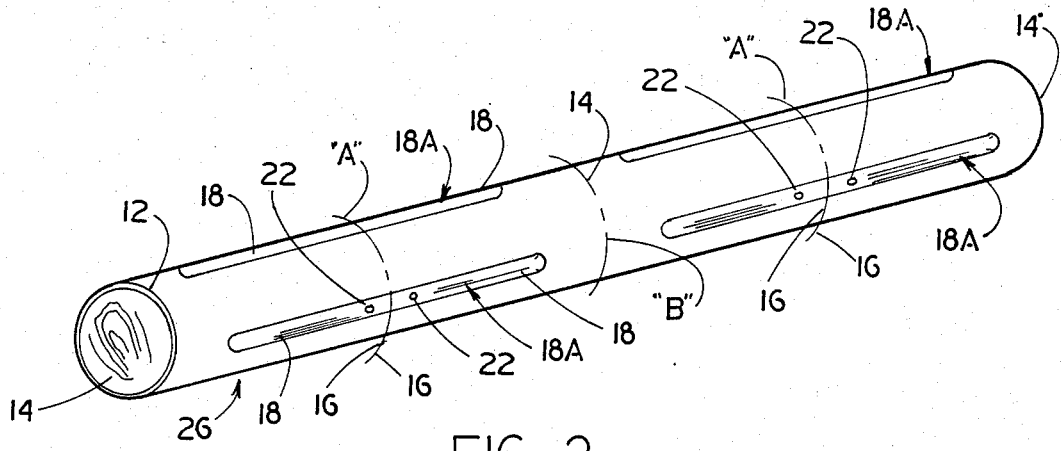
FIG. 2 is a perspective view of a filter rod tow from which the representative filter of FIG. 1 is made, and which the apparatus of the present invention is capable of manufacturing.

Now with reference to FIG. 2, as manufacturing expedient, individual filter rods 10 are manufactured from a filter tow 26. The filter tow 26 is of a generally cylindrical shape and is as long as a preselected number of filter rods 10. The filter tow 26 is formed with longitudinally extending grooves 18A, each of which is twice as long as a groove 18 in the filter rod 10. The double length grooves 18A are arranged in groups of circumferentially spaced apart grooves, the groups being spaced apart longitudinally of the filter rod tow 26. Each group of double length grooves 18A consists of from three to seven grooves circumferentially, equally spaced apart about the perimeter of the filter rod tow 26. Further, in the manufacture of filter rods 10 incorporating the small apertures 22 in the grooves 18, each double length groove 18A is formed with twice the number of apertures 22 as in each groove 18 of the finished filter rod 10 arranged symetrically to each side of the transverse centerline of the double length groove 18A. The filter rod 26 is severed, generally transversely to the longitudinal centerline of the filter tow 26, at intervals corresponding to the desired filter rod 10 length, into individual filter rods 10. As illustrated, the filter tow 26 is severed at locations (denoted by the dashed lines "A") at the transverse centerline of the double length grooves 18A, and a location (denoted by the dashed line "B") generally halfway between adjacent groups of double length grooves 18A. Thus, in the illustration of FIG. 2, four individual filter rods 10 are produced by severing the filter tow 26 at the dashed lines "A" and "B".

Figure 3:
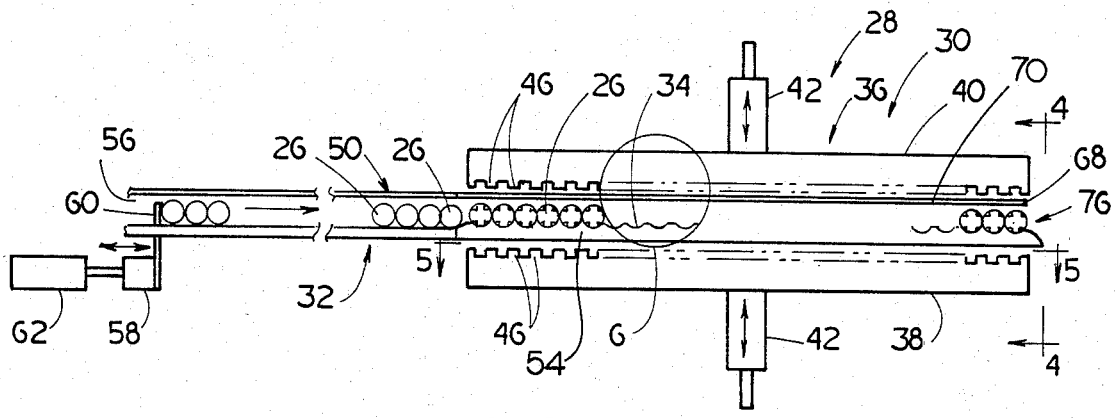
FIG. 3 is a side view of one advantageous embodiment of an apparatus of the present invention.
Figure 4:
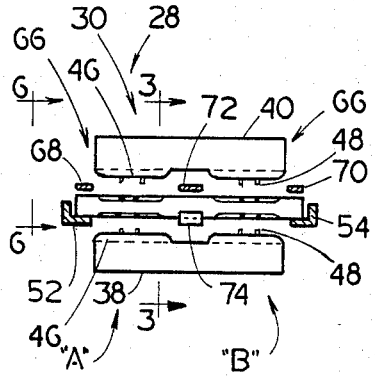
FIG. 4 is an end view of the apparatus of FIG. 3 as viewed in the direction of arrows 4—4 in FIG. 3.

FIGS. 3 and 4 show an apparatus, generally denoted as the numeral 28, for making the grooves 18, and, optionally also the apertures 22 in the filter rod 10 of FIG. 1. For the reasons mentioned above, and as a further manufacturing expedient, the apparatus 28 is adapted to form double length grooves 18A, and optional apertures 22, in a plurality of filter rod tows 26 at one time in order to obtain a high rate of production. Therefore, the following discussion will speak to forming double length grooves 18A in the filter tows 26, but it should be clearly understood that the apparatus 28 could be just as readily used to form grooves 18 in individual filter rods 10 essentially without modification.

Referring to FIGS. 3-6, the apparatus 28 comprises groove forming means 30 for forming the double length grooves 18A in the filter tow 26, means 32 for conveying the filter tows 26 through the groove forming means 30, and positioning means 34 for properly positioning the filter tows 26 in the groove forming means 30, and positioning means 34 for properly positioning the filter tows 26 in the groove forming means 30 prior to the forming of the double length grooves 18A in the filter tow 26.

Figure 6:
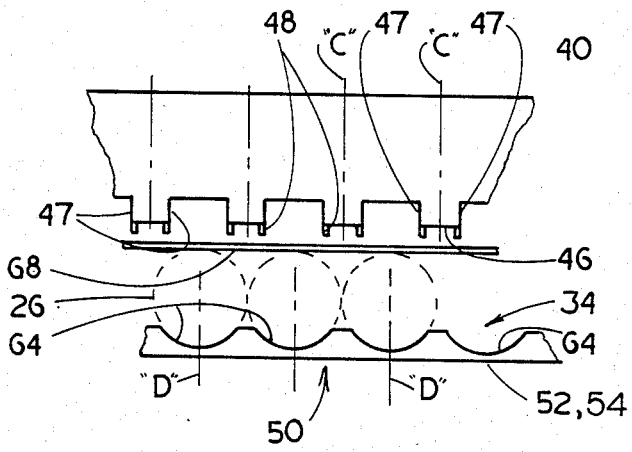
FIG. 6 is an enlarged view of that area of FIG. 3 encompassed by the circle 6 in FIG. 3.
Figure 5:
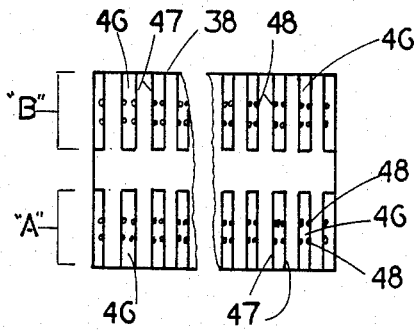
FIG. 5 is a top view of a portion of the apparatus of Figure as viewed in the direction of arrows 5—5 in FIG. 3.

The groove forming means 30 is shown as comprising a reciprocating die 36 having a vertically movable lower die block 38 and a vertically movable upper die block 40 in facing, overlaying relationship with the lower die block 38. The lower and upper die blocks 38 and 40 are mounted for coordinated movement toward and away from each other. Toward this end, the lower and upper die blocks 38 and 40 can be vertically moved by, for example, hydraulic or pneumatic cylinders 42. The lower and upper die blocks 38 and 40 are essentially identical and, therefore, for the sake of brevity and clarity of discussion only the lower die block 38 will be hereinafter described in detail, it being fully understood that the description applies equally to the upper die block 40 as well. Therefore, the numerals denoting components and features common to both the lower and upper die blocks are the same in the illustrations of the lower and upper die blocks 38 and 40. As shown in FIGS. 3 through 5, the die block 38 comprises groove impressing means at its working surface for impressing the double length grooves 18A in the filter tow 26 when the lower and upper die blocks are moved toward each other. The groove impressing means is shown as including a plurality of elongated, spaced apart, generally parallel projections 46 jutting from the face of the die block. The gap between adjacent groove forming projections 46 is less than the diameter of the filter tow 26. The groove forming projections 46 extend longitudinally across the width of the die 36 substantially perpendicular to the path of the converyor means 32 through the die 36. As can be best seen in FIGS. 4 and 5, the groove forming projections 46 are further arranged in longitudinally aligned and longitudinally spaced apart ranks "A" and "B" with each one of the groove forming projections 46 of rank "A" being longitudinally aligned with a different one of the groove forming projections 46 of the rank "B". The lower and upper die blocks 38 and 40 are oriented with their groove forming projections 46 in facing relationship such that each one of the groove forming projections 46 of the upper die block 40 is in parallel alignment with a different one of the groove forming projections 46 of the lower die block 38. With particular reference to FIGS. 5 and 6, each of the groove forming projections 46 includes two longitudinal working edges 47 which are embedded into the filter tows 26 to form the double length grooves 18A. As shown in FIG. 6, the distance between longitudinal centerlines (denoted by the letter "C") of adjacent groove forming projections 46 is generally equal to a filter tow diameter, the distance between adjacent working edges 47 of adjacent groove forming projections 46 is less than a filter tow diameter, and the longitudinal centerlines "C" of the groove forming projections 46 are in alignment with the boundary between adjacent filter tows 26 located in the die 36.

For manufacturing filter rods 10 having apertures 22 in the grooves 18, the die blocks 38 and 40 further include aperture forming means for making the apertures 22 in the double length grooves 18A of the filterr tow 26. As shown in FIGS. 4, 5 and 6, the apertures forming means is in the form of small punches 48 located along the working edges 47 of the groove forming projections 46 and projecting outwardly therefrom at generally a right angle to the working face of the die block. As can be best understood by reference to FIGS. 1 and 2, the number, shape and size of the punches 48 is dictated by the number, shape and size of the apertures 22 to be formed in the grooves 18A of the filter tow 26, and the position of the punches 48 along the groove forming projections 46 is dictated by the position of the apertures 22 along the grooves 18 of the filter rod 10 from the mouth end 16 of the filter rod. As can be best seen by reference to FIGS. 4 and 5, the number of punches 48 along each groove forming projections 46 are symetrically arranged to each side of the transverse centerline of the groove forming projection. FIGS. 4 and 5 illustrate two punches 48 at each working edge 47 of each groove forming projection 46 equally spaced to either side of the transverse centerline of the groove forming projection so that the resulting individual filter rods 10 to be cut from the grooved filter tow 26 will have one apertures 22 in each of its grooves 18.

With continued reference to FIGS. 3, 4 and 6, the filter tow conveying means 32 comprises an elongated channel structure 50 horizontally extending completely through the die 36 between the lower and upper die blocks 38 and 40 defining a confined path for the filter tows 26 through the die 36. The filter tows 26 are oriented within the channel structure 50 transverse to the direction of the path through the die 36 defined by the channel structure 50. Toward this end, as can be best seen in FIG. 4, the channel structure 50 includes two parallel, spaced apart, elongated side rails 52 and 54. The side rails 52 and 54 are generally "L" shaped in transverse cross-section and are disposed in facing relationship. The side rails 52 and 54 are spaced such that the distance between their vertical stems is approximately equal to the length of a filter tow 26 so that the opposite ends of a filter tow 26 are caged between the vertical stems of the "L" shaped side rails 52 and 54. The end portions of the filter tows 26 are supported on the horizontal legs of the "L" shaped side rails 52 and 54 and slide therealong through the die 36. Ungrooved filter tows 26 are loaded into one open end 56 of the channel structure 50 transverse to the defined path of travel along the channel structure 50 and in side-by-side abutting relationship.

The filter tow conveying means 32 also includes a filter tow pusher device 58 located at the open loading end 56 of the channel structure 50 for pushing the filter tows 26 transversely along the channel structure into the die 36 from one side thereof and out of the die 36 from its opposite side. As shown in FIG. 3, the pusher device 58 includes a paddle 60 located between the side rails 52 and 54 and adapted for movement longitudinally of the channel structure 50 into and out of the space between the side rails 52 and 54. The paddle 60 is actuated by means of, for example, an hydraulic or pneumatic cylinder 62. When the paddle 60 is moved into the space between the side rails 52 and 54, it pushes against the last ungrooved filter tow 26 in line in the channel structure 50, thus, causing all of the filter tows 26 to move along the channel structure 50.

The filter tows 26 located between the lower and upper die blocks 38 and 40 are held in a proper position relative to the groove forming projections 46 of the die blocks 38 and 40 for the grooving operation by the positioning means 34. As shown in FIGS. 3, 4, and 6, the positioning means 34 includes a plurality of notches 64 formed in the horizontal legs of the "L" shaped side rails 52 and 54 of the channel structure 50. Each of the notches 64 of the side rail 52 is coaxially aligned with a different one of the notches 64 of the other side rail 54 across the space between the side rails 52 and 54. Each pair of coaxially aligned notches 64 receives the opposite end portions of a filter tow 26. The notches 64 are spaced apart along that portion of the length of the side rails 52 and 54 located between the die blocks 38 and 40. As illustrated in FIGS. 3 and 6, the spacing between the centerlines of adjacent notches 64 corresponds to approximately the diameter of a filter tow 26. Further, the centerline (denoted by the letter "D" in FIG. 6) of each notch 64 is in alignment with a different one of the centerline of the gaps between adjacent groove forming projections 46. Therefore, each pair of notches 64 in the side rails 52 and 54 locates a filter tow 26 in the die 36 in longitudinal alignment with the adjacent working edges 47 of adjacent groove forming projections 46.

As can be best seen in FIGS. 3, 4 and 6, stripper means are provided for holding the grooved tows 26 in the notches 64 as the lower and upper die blocks 38 and 40 move vertically away from each other so that the groove forming projections 46, and aperture forming punches 48 if used, can be extracted from the filter tow 26 after the double length grooves 18A and apertures 22 have been formed therein. As shown, the stripper means comprises two elongated horizontal top plates 68 and 70 each located in overlaying, spaced apart, parallel relationship to a different one of the horizontal leg portions of the siderails 52 and 54, respectively, and a pair of elongated, horizontal, parallel spaced apart stripper plates 72 and 74 located parallel to and intermediate the side rails 52 and 54 in the space between the ranks "A" and "B" of groove forming projections 46. The upper stripper plate 72 is in parallel alignment with and between the top plates 68 and 70, and the lower stripper plate 74 is in parallel alignment with and between the horizontal legs of the "L" shaped side rails 52 and 54. The spaces between the top plates 68 and 70, and the horizontal leg portion of the side rails 52 and 54, respectively, and the space between the upper and lower stripper plates 72 and 74 generally corresponds to the diameter of a filter tow 26.

After the plurality of the filter tows 26 in the die 36 are grooved, they are pushed by the next to be grooved filter tows 26, upon actuation of the pusher device 58, out of the apparatus 28 through the open unloading end 76 of the channel structure 50 opposite the open loading end 56.

Figure 8:
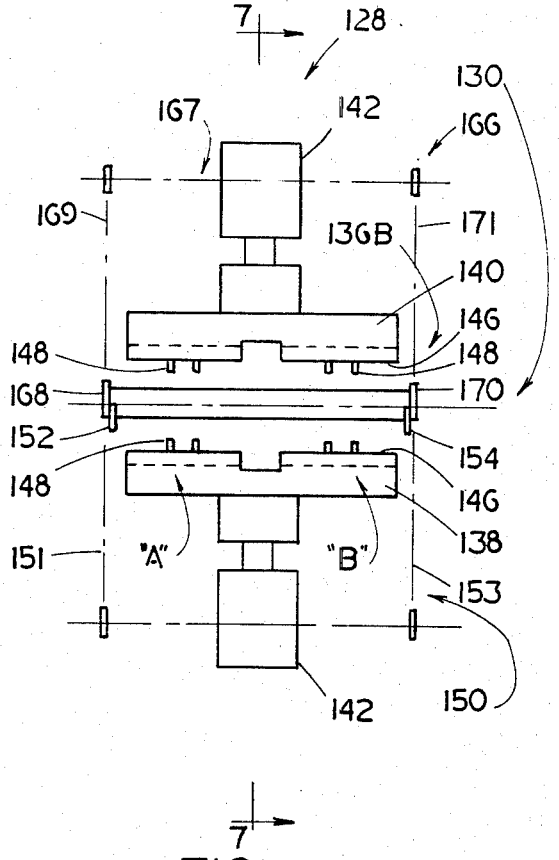
FIG. 8 is an end view of the apparatus of FIG. 7 as seen in the direction of arrows 8—8 in FIG. 7.
Figure 7:
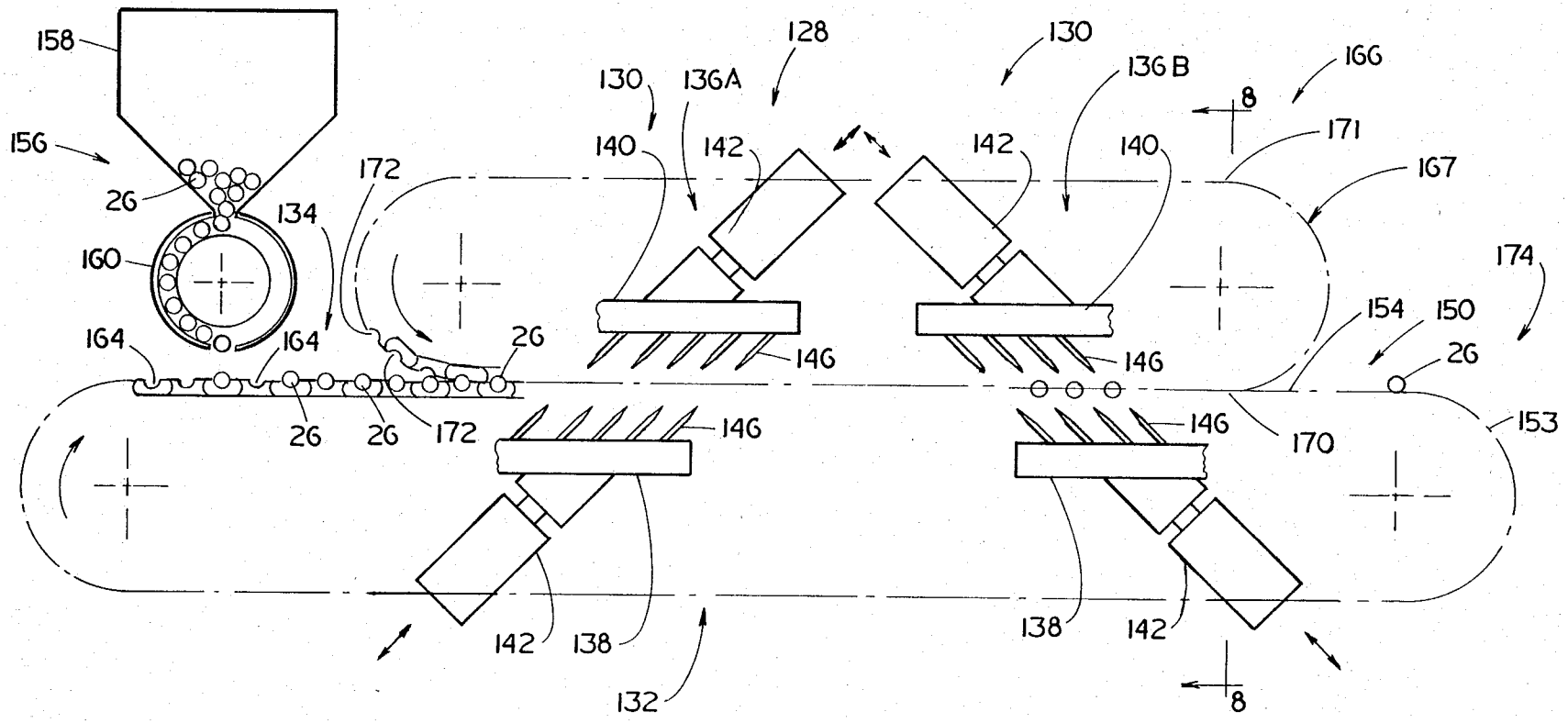
FIG. 7 is a side view of another advantageous embodiment of the present invention.

FIGS. 7 and 8 illustrate another advantageous apparatus, generally denoted as the numeral 128, for making the double length grooves 18A, and optionally also the apertures 22, in the filter tow 26. The apparatus 128 includes groove forming means 130 for forming the double length grooves 18A in the filter rod 26, means 132 for conveying the filter tows 26 through the groove forming means 130 and positioning means 134 for properly positioning the filter tows 26 in the groove forming means 130 prior to the forming of the double length grooves 18A in the filter tows 26.

The groove forming means 130 is shown as including two sets of reciprocating dies 136A and 136B spaced apart from one another in the direction of movement of the filter tows 26 through the apparatus 128. Each die 136A and 136B includes a movable lower die block 138 and a movable upper die block 140. The lower and upper die blocks 138 and 140 of each die 136A and 136B are movable, at an angle to the vertical, toward and away from each other. The die blocks 138 and 140 can be moved by, for example, hydraulic or pneumatic cylinders 142. The angle to the vertical is a function of the location of the grooves 18A circumferentially of the filter tow 26, to be formed in the filter tow 26. As shown in FIGS. 7 and 8, the groove forming means 130 is adapted to make four double length grooves 18A equally spaced circumferentially about each filter tow 26. Thus, the angular displacement between adjacent circumferentially spaced grooves 18A of the filter tow 26 is approximately 90°. Each die 136A and 136B is adapted to concurrently form two diametrically opposed grooves 18A in each of the filter tows 26. Toward this end, the die blocks 138 and 140 of the die 136A move toward and away from each other at an angle of 45° to the vertical, and the die blocks 138 and 140 of the die 136B move toward and away from each other at the complementary 45° angle to the vertical. The die blocks 138 and 140 of each die 136A and 136B can be moved by, for example, hydraulic or pneumatic cylinders 142. The lower and upper die blocks 138 and 140 of the dies 136A and 136B are essentially identical and, therefore, for the sake of brevity of discussion onely one of the lower die blocks 138 will be hereinafter described in detail, it being fully understood that the description applies equally to the other lower die block 138 and both upper die blocks 140 as well. Thus, the numerals denoting components and features common to all of the die blocks are the same in the illustrations. As shown in FIGS. 7 and 8, the die block 138 comprises groove impressing means at its working surface for impressing the double length grooves 18A in the filter tow 26 when the upper and lower die blocks 138 and 140 are moved toward each other. The groove impressing means is shown as including a plurality of elongated, spaced apart, generally blade-like projection 146 jutting from the fact of the die block. As can be best seen in FIG. 7, the projections 146 are spaced apart by a distance greater than a filter tow diameter. The blade-like projections 146 project at an angle of approximately 45° from the face of the die block in the direction of movement of the die block. The blade-like projections 146 extend longitudinally across the width of the die 136A, 136B substantially perpendicular to the path of the conveyor means 132 through the die 136A, 136B. As can be seen in FIG. 8, the groove forming blade-like projections 146 are further arranged in longitudinally aligned and longitudinally spaced apart ranks "A" and "B" with each one of the groove forming projections 146 of rank "A" being longitudinally aligned with a different one of the groove forming projections 146 of the rank "B". The lower and upper die blocks 138 and 140 of each die 136A and 136B are oriented with their blade-like groove forming projections 146 in facing relationship such that each one of the groove forming projections 146 of the upper die block 140 is in parallel alignment with a different one of the groove forming projections 146 of the lower die block 138 in the direction of movement of the die blocks 138 and 140 toward and away from each other.

For manufacturing filter rods 10 having apertures 22 in the grooves 18, the die blocks 138 and 140 further include aperture forming means for making the apertures 22 in the double length grooves 18A of the filter tow 26. As shown, the apertures forming means is in the form of small punches 148 located along the groove forming projection 146 and projecting outwardly therefrom. As can be best visualized by reference to FIGS. 1 and 2, the number, shape and size of the punches 148 are dictated by the number, shape and size of the apertures 22 to be formed in the grooves 18A of the filter tow 26. Further, the position of the punches 148 along the groove forming projections 146 is dictated by the position of the apertures 22 along the grooves 18 of the filter rod 10 from the mouth end 16 of the filter rod. As can be best seen in FIG. 8, the number of punches 148 along each groove forming projection 146 are equally divided and symetrically arranged to each side of the transverse centerline of the groove forming projection 146. FIG. 8 illustrates two punches 148 at each groove forming projection 146 equally spaced to either side of the transverse centerline of the groove forming projection 146 so that the resulting individual filter rods 10 to be cut from the grooved filter tow 26 will have one aperture 22 in each of its grooves 18.

With continued reference to FIGS. 7 and 8, the filter tow conveying means 132 is shown as an endless conveyor system, generally denoted as the numeral 150, for moving the filter tows 26 through the groove forming dies 136A and 136B. As shown, the endless conveying system 150 includes two generally parallel, spaced apart endless chain conveyor devices 151 and 153. The top flight 152 of the endless chain of conveyor device 151 and the top flight 154 of the endless chain of conveyor device 153 being parallel and horizontally disposed. The top flights 152 and 154 extend past the dies 136A and 136B approximately midway between the lower and upper die blocks 138 and 140 of the dies 136A and 136B and, as can be best seen in FIG. 8, are located at opposite sides of the dies 136A and 136B. The filter tows 26 are carried on the top flight 152 and 154 through the dies 136A and 136B, and are oriented transverse to the direction of the path of travel of the conveyor devices 151 and 153. Toward this end, the endless chain conveyor devices 151 and 153 are spaced apart by a distance less than the overall length of a filter tow 26 such that the opposite end portions of the filter tows 26 are supported by the top flights 152 and 154.

The endless chain conveyor devices 151 and 153 extend beyond the dies 136A ad 136B both upstream of the die 136A and downstream of the die 136B. Ungrooved filter tows 26 are loaded onto the top flights 152 and 154 of the chain conveyor devices 151 and 153 at a loading region 156 upstream of the die 136A by means of, for example, a hopper device 158 which stores a plurality of ungrooved filter tows 26. The hopper device 158 includes a filter tow dispenser 160 which operates to deposit filter tows 26 on the top conveyor flights 152 and 154 in timed relationship to the linear speed of the top conveyor flights.

The filter tows 26 moving with the top conveyor flights 152 and 154 of the conveyor devices 151 and 153 are held in position relative to the groove forming projections 146 for the grooving operation by the positioning means 134. As shown in FIGS. 7 and 8, the filter tow positioning means 134 comprises a plurality of spaced apart filter tow receiving notches 164 formed in the endless conveyor chains 151 and 153. As shown, one notch 164 is formed in each link of the endless conveyor chains of conveyor devices 151 and 153 such that the centerline-to-centerline space between adjacent notches 164 is essentially equal to the spacing between adjacent groove forming projections 146 of the dies 136A and 136B. Each of the notches 164 of the endless conveyor chain of conveyor device 151 is in alignment with a different one of the notches 164 of the endless conveyor chain of the conveyor device 153 across the space between the conveyor devices 151 and 153. Each pair of aligned notches 164 of the top flights 152 and 154 receives the opposite end portions of a filter tow 26, thus, locating the filter tows 26 in longitudinal alignment with selected groove forming projections 146 as the top flights 152 and 154 of the conveyor system 150 move the filter tows 26 through the dies 136A and 136B.

With continued reference to FIGS. 7 and 8, stripper means, generally denoted as the numeral 166, is provided for holding the grooved filter tows 26 in place in the notches 164 on the top conveyor flights 152 and 154 as the lower and upper die blocks 138 and 140 move away from each other so that the groove forming projections 146, and aperture forming punches 148 if used, can be extracted from the filter tow 26 after the forming operation. As shown, the stripper means 166 includes an endless chain-like system 167 located over the conveyor system 150 through the dies 136A and 136B. As illustrated, the endless chain-like system 167 includes two generally parallel, spaced apart endless chain devices 169 and 171. The bottom flight 168 of the endless chain of the chain device 169 is horizontally disposed, generally parallel to and located over at least that portion of the top flight 152 of the conveyor chain of the chain device 151 between the dies 136A and 136B, and the bottom flight 170 of the endless chain of the chain 171 is horizontally disposed, generally parallel to and located over the top flight 154 of the conveyor chain of the chain device 153 between the dies 136A and 136B. A plurality of spaced apart notches 172 are formed in the endless chains of the chain devices 169 and 171. As shown, one notch 172 is formed in each link of the endless chains such that the centerline-to-centerline distance between adjacent notches 172 is essentially equal to the centerline-to-centerline distance between adjacent notches 164 of the endless chain conveyors 151 and 153. Each of the notches 172 of the endless chain device 169 is in coaxial alignment with a different one of the notches 172 of the other endless chain device 171 and move with the top flights 152 and 153 of the endless conveyor chain devices 151 and 153 through the dies 136A and 136B. The notches 172 of the endless chain devices 169 and 171 are in registration with the notches 164 in the endless conveyor chain devices 151 and 153, respectively, thus capturing filter tows 26 between registered notches 164 and 172. When the filter tows 26 have been moved into the die 136A in longitudinal alignment with the groove forming projections 146, the lower and upper die blocks 138 and 140 are moved toward each other causing the groove forming projections 146 to embed in the filter tows 26, forming two diametrically opposite apart grooves 18A in the filter tow 26. Concurrently, if the groove forming projections 146 include aperture forming punches 148, apertures 22 are made in the grooves 18A. As the die blocks 138 and 140 of the die 136A move away from the filter tow 26, the now grooved filter tows 26 are held in position on the top flights 152 and 154 of the chain devices 151 and 153 by the bottom flights 168 and 170 of the endless chain devices 169 and 171. Next, the conveyor system 150 moves the filter tows 26 from the die 136A into the die 136B in longitudinal alignment with the groove forming projections 146. The lower and upper die blocks 138 and 140 of the die 136B are moved toward each other causing the groove forming projections 146 to embed in the filter tows 26 forming two diametrically opposed apart grooves 18A in the filter tow 26 equally spaced circumferentially of the tow 26 between the two grooves 18A formed by the die 136A. Again, concurrently, if the groove forming projections 146 include aperture forming punches 148, apertures 22 are made in the grooves 18A. As the die blocks 138 and 140 of the die 136B move away from the filter tow 26, the now grooved filter tows 26 are held in position on the top flights 152 and 154 of the chain devices 151 and 153 by the bottom flights 168 and 170 of the endless chain devices 169 and 171. The grooved filter tows 26 are removed from the conveying system 150 downstream of the die 136B in the unloading region 174 as the endless conveyor chain of the chain devices 151 and 153 travel around the head sprocket of the endless conveyor system 150.

In the appended claims, the term filter rod is used in a generic sense to cover individual filter rods or filter tows from which individual filter rods are cut as discussed above in relationship to FIGS. 1 and 2.

The foregoing detailed description is given primarily for clearness of understanding and no limitations are to be understood therefrom for modifications will become obvious to those skilled in the art upon reading this disclosure and may be made without department from the spirit of the invention or scope of the appended claims.

What is claimed is:

1. An apparatus for making grooves in filter rods comprising:

die means comprising a lower die block and an upper die block, both die blocks being adapted for movement toward and away from each other, the lower die block having elongated groove forming projections projecting generally toward the upper die block and the upper die block having elongated groove forming projections projecting generally toward the lower die block, whereby the groove forming projections of the lower die block and upper die block are adapted to be embedded into a filter rod disposed between the lower and upper die block to impress grooves in the filter rod when the lower and upper die blocks are moved toward each other;

means disposed between the lower and upper die blocks defining a path of travel of the filter rods through the die means;

means associated with the path defining means for positioning the filter rods to be grooved in the die means between the lower and upper die blocks in longitudinal alignment with the groove forming projections;

stripper means for holding the grooved filter rods in the path defining means as the lower and upper die blocks move away from each other to allow the groove forming projections to be extracted from the filter rod; and, means for moving the lower and upper die blocks toward and away from each other.

2. The apparatus of claim 1, wherein the filter rods are oriented in the channel defining means transversely to the direction of travel of the filter rods along the channel defining means.

3. The apparatus of claim 2, wherein the channel defining means cages the opposite end of the filter rods.

4. The apparatus of claim 1, wherein the filter rod positioning means comprises filter rod receiving notches formed in the filter rod path defining means.

5. The apparatus of claim 1, wherein:

the elongated groove forming projections of the lower die block comprise a plurality of elongated, spaced apart, generally parallel projections longitudinally oriented generally transverse to the path of travel of the filter rods through the die means; and, the elongated groove forming projections of the upper die block comprise a plurality of elongated, spaced apart, generally parallel projections longitudinally oriented generally transverse to the path of travel of the filter rods through the die means.

6. The apparatus of claim 5, wherein each one of the elongated groove forming projections of the lower die block is in longitudinal alignment with a different one of the elongated groove forming projections of the upper die block in the direction of movement of the die blocks toward and away from each other.

7. The apparatus of claim 1, wherein:

the groove forming projections of the lower die block comprises longitudinally aligned, longitudinally spaced apart ranks of rows of groove forming projections, each groove forming projection of one rank being in longitudinal alignment with a different one of the groove forming projections of the other rank; and, the groove forming projections of the upper die block comprise longitudinally aligned, longitudinally spaced apart ranks of rows of groove forming projections, each groove forming projection of one rank being in longitudinal alignment with a different one of the groove forming projections of the other rank.

8. The apparatus of claim 1, wherein the path defining means comprises a pair of spaced apart, generally parallel, elongated side rails horizontally extending past the die means between the lower and upper die blocks.

9. The apparatus of claim 8, wherein the side rails each have a generally "L" shaped transverse cross-section, and the side rails are disposed in mutual facing relationship.

10. The apparatus of claim 8, wherein the stripper means comprise a pair of elongated top plates located in overlaying, spaced apart, generally parallel relationship to the pair of side rails.

11. The apparatus of claim 8, wherein the positioning means comprises a plurality of filter rod receiving notches formed in each of the side rails, each of the notches in one side rail being coaxially aligned with a different one of the notches in the other side rail.

12. The apparatus of claim 1, wherein the path defining means comprises an endless conveyor system having at least one flight horizontally extending past the die means between the lower and upper die blocks for supporting the filter rods and moving the filter rods through the die means.

13. The apparatus of claim 12, wherein the filter rod positioning means comprises filter rod receiving notches formed in the endless conveyor system.

14. The apparatus of claim 12, wherein the stripper means comprises an endless conveyor system having at least one flight parallel to and horizontally disposed above the at least one flight of the endless conveyor system of the path defining means past the die between the lower and upper die blocks.

15. The apparatus of claim 14, wherein notches are formed in the endless conveyor system of the stripper means, and as the horizontal bottom flight of the endless conveyor system of the stripper means moves through the die means the notches therein are in registration with the notches in the top flight of the endless conveyor system of the path defining means passing past the die means.

16. The apparatus of claim 1, wherein the lower and upper die blocks of the die means are adapated for vertical movement toward and away from each other.

17. The apparatus of claim 1, wherein the die means comprises:

a first die having lower and upper die blocks adapted for movement toward and away from each other at an angle of approximately 45° to the vertical;

a second die having lower and upper die blocks adapted for movement toward and away from each other at the complementary 45° to the vertical; and, the second die being located downstream of the first die along the defined path of travel of the filter rods through the die means.

18. The apparatus of claim 1, further comprising aperture forming means associated with each of the groove forming projections of the lower die block for making apertures in the grooves of the filter rod generally concurrently with the formation of the grooves; and, aperture forming means associated with each of the groove forming projections of the upper die block for making apertures in the grooves of the filter rod generally concurrently with the formation of the grooves.

* * * * *